US008025288B2

(12) United States Patent
Shoji et al.

(10) Patent No.: US 8,025,288 B2
(45) Date of Patent: Sep. 27, 2011

(54) CONVEYING DEVICE AND IMAGE FORMING APPARATUS

(75) Inventors: Yutaka Shoji, Ibaraki-Pref (JP); Junji Shirakawa, Ibaraki-Pref (JP); Takayuki Muneyasu, Ibaraki-Pref (JP)

(73) Assignee: Ricoh Company, Ltd., Tokyo (JP)

( * ) Notice: Subject to any disclaimer, the term of this patent is extended or adjusted under 35 U.S.C. 154(b) by 276 days.

(21) Appl. No.: 12/073,627

(22) Filed: Mar. 7, 2008

(65) Prior Publication Data

US 2008/0240821 A1 Oct. 2, 2008

(30) Foreign Application Priority Data

Mar. 29, 2007 (JP) ..... 2007-086880

(51) Int. Cl.
*B65H 9/04* (2006.01)

(52) U.S. Cl. ..... 271/242; 271/245; 271/270

(58) Field of Classification Search ..... 271/236, 271/242, 245, 270
See application file for complete search history.

(56) References Cited

U.S. PATENT DOCUMENTS

| | | | | |
|---|---|---|---|---|
| 5,335,904 | A * | 8/1994 | Ryuzaki | 271/272 |
| 5,967,506 | A * | 10/1999 | Miki et al. | 271/10.13 |
| 6,092,803 | A * | 7/2000 | Munenaka | 271/242 |
| 6,863,273 | B2 * | 3/2005 | Otto | 271/270 |

FOREIGN PATENT DOCUMENTS

| | | | |
|---|---|---|---|
| JP | 59190144 | A * | 10/1984 |
| JP | 03-009373 | | 1/1991 |
| JP | 05-008900 | | 1/1993 |
| JP | 05-124752 | | 5/1993 |
| JP | 06-127753 | | 5/1994 |
| JP | 2893540 | | 3/1999 |
| JP | 2001-341888 | | 12/2001 |
| JP | 2002-265097 | | 9/2002 |

OTHER PUBLICATIONS

Abstract of JP 03-094275 published on Apr. 19, 1991.

* cited by examiner

*Primary Examiner* — Michael McCullough
(74) *Attorney, Agent, or Firm* — Harness, Dickey & Pierce, P.L.C.

(57) ABSTRACT

A conveying device that conveys a recording medium includes an aligning member into which the leading edge of a recording medium bumps and a control unit that changes conveyance speed of the recording medium moving on a conveying path to bump into the aligning member.

12 Claims, 5 Drawing Sheets

CONVEYING DEVICE AND IMAGE FORMING APPARATUS

CROSS-REFERENCE TO RELATED APPLICATIONS

The present application claims priority to and incorporates by reference the entire contents of Japanese priority document 2007-086880 filed in Japan on Mar. 29, 2007.

BACKGROUND OF THE INVENTION

1. Field of the Invention

The present invention relates to a conveying device and an image forming apparatus.

2. Description of the Related Art

For image forming apparatuses such as copiers or printers, a technology has been proposed for accurately transferring an image carried on an image carrier, such as a photosensitive drum or an intermediate transfer belt, onto a desired position of the recording medium. In such a technology, after skew of a recording medium is corrected with an aligning member such as a gate (a plate-shaped member) or a pair of registration rollers, the recording medium is conveyed to a transfer unit.

Japanese Patent No. 2893540 discloses a conventional technology in which, after the leading edge of a recording medium is positioned by an aligning member, registration rollers at downstream of the aligning member moves in the width direction while holding the recording medium. Thus, misalignment of the recording medium in the width direction (direction perpendicular to a direction in which the recording medium is conveyed) is corrected, and the recording medium is conveyed to a transfer unit.

Japanese Patent Application Laid-open No. 2002-265097 discloses another conventional technology in which, after skew of a recording medium is corrected by an aligning member, the recording medium is conveyed to a transfer unit by registration rollers located upstream of the aligning member.

With the conventional technologies, however, a recording medium bumps into the aligning member for skew correction, which may cause damage to the leading edge of the recording medium or buckling of the recording medium (see FIG. 7). This tendency is noticeable when a recording medium such as a thin or brittle sheet is used.

Especially, in high-speed image forming apparatuses, a recording medium is conveyed at high speed and bumps into the aligning member with a larger impact. This is not negligible.

SUMMARY OF THE INVENTION

It is an object of the present invention to at least partially solve the problems in the conventional technology.

According to an aspect of the present invention, there is provided a conveying device that conveys a recording medium. The conveying device includes an aligning member into which a leading edge of the recording medium bumps, and a control unit that changes conveyance speed of the recording medium moving on a conveying path to bump into the aligning member.

According to another aspect of the present invention, there is provided an image forming apparatus including a conveying device. The conveying device includes an aligning member into which a leading edge of the recording medium bumps, and a control unit that changes conveyance speed of the recording medium moving on a conveying path to bump into the aligning member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
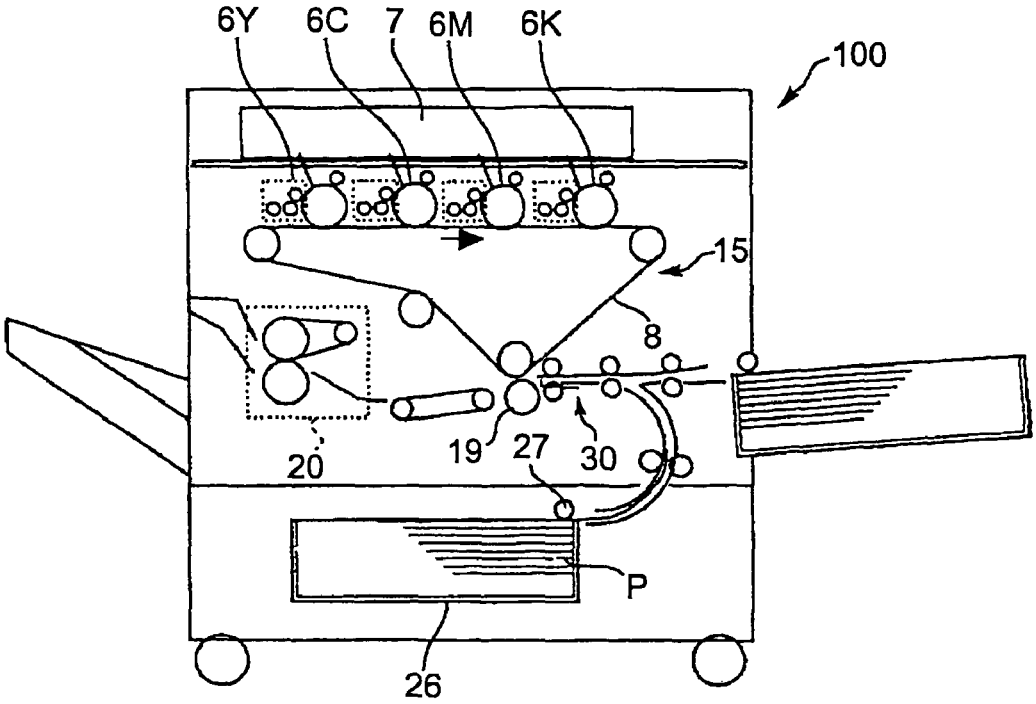
FIG. 1 is a schematic diagram of an image forming apparatus according to an embodiment of the present invention.

Exemplary embodiments of the present invention are explained in detail below with reference to the accompanying drawings. Like reference numerals refer to corresponding elements throughout the several views of the drawings, and the explanation thereof is not repeated or simplified as appropriate.

FIG. 1 is a schematic diagram of an image forming apparatus 100 according to an embodiment of the present invention. While the image forming apparatus 100 is explained below as a printer, it can be a copier, a facsimile machine, a scanner, and a multifunction product (MFP) that combines any or all of functions of these. The image forming apparatus 100 includes an intermediate transfer belt device 15, image forming units 6Y (yellow), 6M (magenta), 6C (cyan), and 6K (black), and a conveying unit 30. The intermediate transfer belt device 15 is arranged in the center of the image forming apparatus 100. The image forming units 6Y, 6M, 6C, and 6K correspond to different colors of yellow, magenta, cyan, and black, respectively, and are arranged in parallel to face an intermediate transfer belt 8 (image carrier) of the intermediate transfer belt device 15. The conveying unit 30 is arranged at the lower right of the intermediate transfer belt device 15.

The image forming units 6Y, 6M, 6C, and 6K are of like configuration and operates in the same manner except for toner color they use, and thus but one of them, the image forming unit 6Y, is described in detail below.

Figure 2:
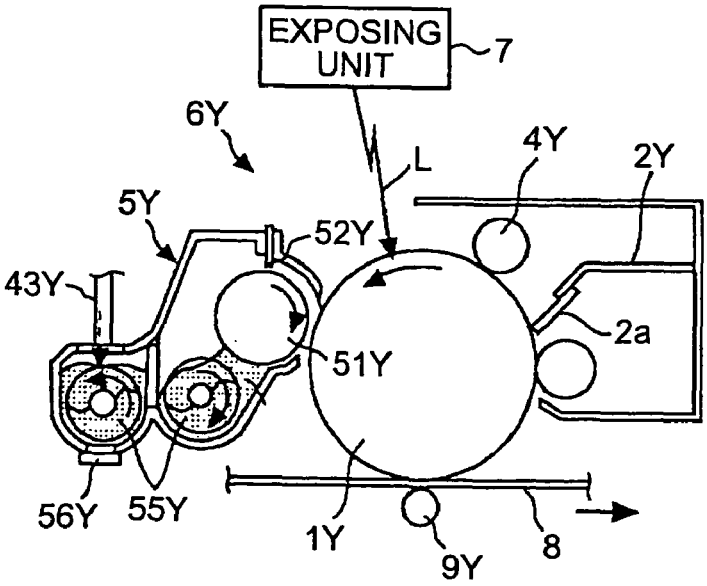
FIG. 2 is a cross section of an image forming unit shown in FIG. 1.

As shown in FIG. 2, the image forming unit 6Y includes a photosensitive drum 1Y as an image carrier and a charging unit 4Y, a developing unit 5Y, a cleaning unit 2Y, and a neutralizing unit (not shown) that are arranged around the photosensitive drum 1Y. An image forming process (charging, exposing, developing, transferring, and cleaning) is performed on the photosensitive drum 1Y to form a yellow image thereon.

The photosensitive drum 1Y is driven to rotate counterclockwise in FIG. 2 by a driving motor (not shown). A surface of the photosensitive drum 1Y is uniformly charged by the charging unit 4Y. The surface of the photosensitive drum 1Y is then irradiated or scanned with a laser beam L emitted from an exposing unit 7. Thus, a yellow electrostatic latent image is formed on the surface of the photosensitive drum 1Y.

The electrostatic latent image is developed into a yellow toner image by the developing unit 5Y. With the rotation of the photosensitive drum 1Y, the electrostatic latent image reaches a position corresponding to the intermediate transfer belt 8 and a transfer roller 9Y. The toner image is transferred (primarily transferred) onto the intermediate transfer belt 8 by the transfer roller 9Y. At this time, residual toner remains on the photosensitive drum 1Y.

The residual toner is removed by a cleaning blade 2*a* and collected into the cleaning unit 2Y. After that, remaining potential is removed from the surface of the photosensitive drum 1Y by the neutralizing unit. In this manner, the image-forming process is performed on the photosensitive drum 1Y.

The image-forming process is also performed on the other image forming units 6M, 6C, and 6K in the same manner as described above for the yellow image forming unit 6Y. That is, photosensitive drums 1M, 1C, and 1K in the image forming units 6M, 6C, and 6K are also irradiated with a laser beam L emitted from the exposing unit 7 arranged above each of the image forming units 6M, 6C, and 6K.

Specifically, the exposing unit 7 emits a laser beam L based on image data from a light source, and each of the photosensitive drums 1Y, 1M, 1C, and 1K is irradiated through a plurality of optical elements with the laser beam L deflected by a rotating polygon mirror.

Toner images of different colors are then formed on the photosensitive drums 1Y, 1M, 1C, and 1K through the developing process, and are transferred onto the intermediate transfer belt 8 to be superimposed thereon. Thus, a color image is formed on the intermediate transfer belt 8.

Figure 3:
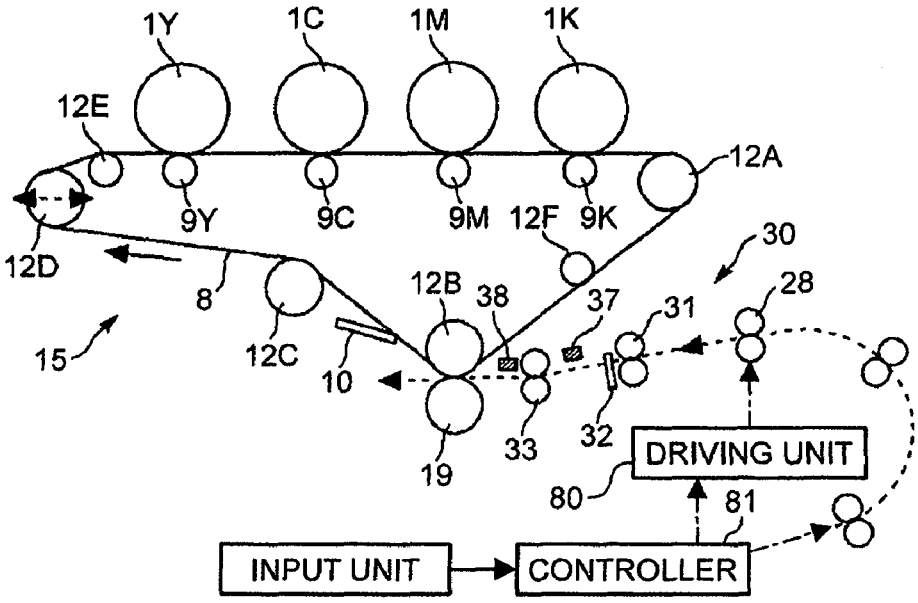
FIG. 3 is a schematic diagram of a conveying device and its neighborhood shown in FIG. 1.

As shown in FIG. 3, the intermediate transfer belt device 15 includes the intermediate transfer belt 8, transfer rollers 9Y, 9M, 9C, and 9K, a driving roller 12A, an opposing roller 12B, supporting rollers 12C to 12F, and an intermediate-transfer cleaning unit 10. While stretched over and supported by the rollers 12A to 12F, the intermediate transfer belt 8 endlessly moves in a direction indicated by an arrow in FIG. 3 with rotation of the driving roller 12A.

The transfer rollers 9Y, 9M, 9C, and 9K and the photosensitive drums 1Y, 1M, 1C, and 1K form primary transfer nips with the intermediate transfer belt 8 therebetween. A transfer voltage (transfer bias) with a polarity opposite to that of toner is applied to the transfer rollers 9Y, 9M, 9C, and 9K.

The intermediate transfer belt 8 moves in the direction indicated by the arrow in FIG. 3 and passes the primary transfer nips in sequence between the transfer rollers 9Y, 9M, 9C, and 9K and the photosensitive drums 1Y, 1M, 1C, and 1K. Thus, toner images of different colors formed on the photosensitive drums 1Y, 1M, 1C, and 1K are primarily transferred onto the intermediate transfer belt 8 to be superimposed thereon.

With the rotation of the intermediate transfer belt 8, the superimposed toner images reach a position (image transfer position) facing a secondary transfer roller 19. The secondary transfer roller 19 and the opposing roller 12B form a secondary transfer nip with the intermediate transfer belt 8 therebetween. The superimposed toner images on the intermediate transfer belt 8 are transferred (secondary transferred) as a color image onto a recording medium (sheet) P conveyed to the secondary transfer nip. At this time, residual toner remains on the intermediate transfer belt 8.

The residual toner is removed from the intermediate transfer belt 8 by the intermediate-transfer cleaning unit 10. In this manner, the transfer process is performed on the intermediate transfer belt 8.

As shown in FIG. 1, the sheet P is fed from a feed cassette 26 arranged at a lower portion of the image forming apparatus 100 (or a feed cassette on a side thereof) through a feeding roller 27, the conveying unit 30, etc. and conveyed to the secondary transfer nip.

Specifically, the feed cassette 26 contains a stack of sheets P. The feeding roller 27 picks a topmost sheet P from the stack and feeds it towards the conveying unit 30 while rotating counterclockwise in FIG. 1.

After the sheet P conveyed to the conveying unit 30 is subjected to skew correction (skew adjustment), lateral registration correction, i.e., misalignment correction in the width direction, and longitudinal registration correction, i.e., misalignment correction in a direction in which the sheet P is conveyed (conveying direction), the sheet P is conveyed to the secondary transfer nip in tune with a color image formed on the intermediate transfer belt 8. Thus, a desired color image is transferred onto the sheet P.

The sheet P is then conveyed to a fixing unit 20 including a fixing roller and a pressing roller, and the color image is fixed on the sheet P with heat and pressure applied by the rollers.

The sheet P is then discharged outside the image forming apparatus 100 by a pair of discharging rollers (not shown). The sheets P are thus sequentially stacked on a stacker as an output image.

In this embodiment, process line speed (speed at which an intermediate transfer belt 8 moves or speed at which the sheet P is conveyed) of the image forming apparatus 100 is set to about 400 millimeters per second.

As shown in FIG. 2, the developing unit 5Y includes a developing roller 51Y facing the photosensitive drum 1Y, a doctor blade 52Y opposite to the developing roller 51Y, conveying screws 55Y arranged in a developer container, a toner supply path 43Y that communicates to the developer container through its opening, and a sensor 56Y that detects a toner concentration in developer. The developing roller 51Y includes a magnet that is fixedly arranged therein, and a sleeve that rotates around the magnet. The developer container contains two-component developer formed of carrier and toner.

The sleeve rotates in a direction indicated by an arrow shown in FIG. 2. Developer carried on the developing roller 51Y due to a magnetic field formed by the magnet moves on the developing roller 51Y with rotation of the sleeve. Developer in the developing unit 5Y is adjusted so that a toner ratio (toner concentration) of the developer is within a predetermined range.

While mixed and stirred with the developer by the conveying screws 55Y, toner supplied to the developer container circulates in two sections of the developer container (in the vertical direction with respect to a sheet surface of FIG. 2). The toner in the developer adheres to the carrier due to frictional charge with the carrier, and is carried on the developing roller 51Y with the carrier by a magnetic force formed on the developing roller 51Y.

The developer on the developing roller 51Y is conveyed in a direction indicated by the arrow shown in FIG. 2 and reaches the doctor blade 52Y at which, after an amount of the developer is properly adjusted, the developer is carried to a position (developing area) facing the photosensitive drum 1Y. Then, the toner is adhered to a latent image formed on the photosensitive drum 1Y by an electric field formed on the developing area. Developer that remains on the developing roller 51Y reaches an upper portion of the developer container with rotation of the sleeve, and is removed from the developing roller 51Y.

Figure 4:
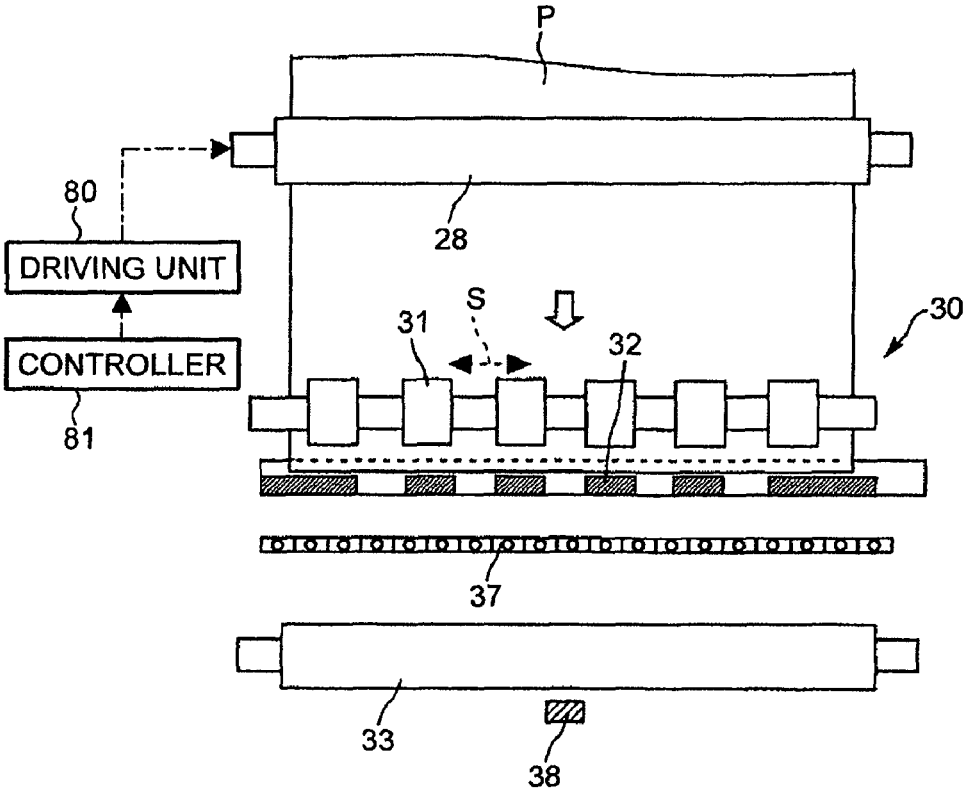
FIG. 4 is a top view of the conveying device.

As shown in FIGS. 3 and 4, the conveying unit 30 includes, along a conveying path of a sheet (indicated by a broken line in FIG. 3), conveying rollers 28, holding rollers 31 as a lateral registration correcting unit, an aligning member 32, and registration rollers 33 as a longitudinal registration correcting unit. A contact image sensor (CIS) 37 is arranged between the aligning member 32 and the registration rollers 33. A photosensor 38 is arranged between the registration rollers 33 and the secondary transfer nip.

The conveying rollers 28 are arranged upstream of the holding rollers 31 in the conveying direction. The conveying rollers 28 are arranged up and down and can contact or separate from each other by a driving mechanism (not shown).

The conveying rollers 28 are independently connected to a driving unit 80 that applies a variable driving force to change the number of revolutions of the conveying rollers 28 under the control of a controller 81. In other words, the conveying rollers 28, the driving unit 80, and the controller 81 change conveyance speed of a sheet immediately before the sheet bumps into the aligning member 32.

The aligning member 32 is formed of a metal plate having a surface (divided into a plurality of portions in a width direction) into which the leading edge of a sheet bumps, so that skew (slanting) and longitudinal registration of the sheet is corrected. The aligning member 32 is configured to open or close the conveying path. Specifically, a cam mechanism (not shown) that engages the aligning member 32 is driven to move the aligning member 32 upward in FIG. 3 at a predetermined timing to close the conveying path, or downward in FIG. 3 to open the conveying path.

The holding rollers 31 constitute a roller unit and are arranged in the width direction at upstream of the aligning member 32 in the conveying direction. The holding rollers 31 are arranged up and down and, by a driving mechanism (not shown), can contact or separate from each other and move in a width direction (S direction indicated by a two-headed broken line arrow shown in FIG. 4). The holding rollers 31 holds a sheet abutting the aligning member 32, and then moves in the width direction to correct lateral registration of the sheet.

The registration rollers 33 are arranged downstream of the aligning member 32 in the conveying direction. After lateral registration is corrected by the holding rollers 31, the sheet bumps into a nip between the registration rollers 33. Accordingly, longitudinal registration of the sheet is corrected. In addition, because the leading edge of the sheet bumps into the registration rollers 33, skew of the sheet is corrected.

The CIS 37 is formed of a plurality of photosensors (including a light-emitting element such as a light emitting diode (LED) and a light-receiving element such as a photodiode) arranged in parallel in the width direction. The CIS 37 detects both edges of a sheet in the width direction to detect an amount by which the sheet shifts in lateral registration. Lateral registration is corrected by the holding rollers 31 based on a result detected by the CIS 37.

The photosensor 38 is arranged downstream of the registration rollers 33 in the conveying direction, and optically detects the leading edge of a sheet conveyed from the registration rollers 33. Then, a timing at which the sheet is conveyed by the registration rollers 33 toward the secondary transfer nip is finely adjusted based on a result detected by the photosensor 38.

Figure 5A:
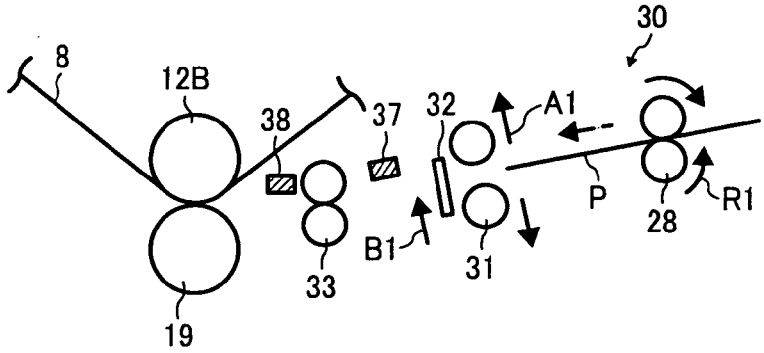
FIGS. 5A to 5D are schematic diagrams for explaining the operation of the conveying device.

As shown in FIG. 5A, a sheet P fed from the feed cassette 26 is conveyed toward the aligning member 32 (in a direction indicated by a broken-line arrow) with rotation of the conveying rollers 28 in R1 direction. At this time, the holding rollers 31 move in A1 direction to open the conveying path. The aligning member 32 moves in B1 direction to close the conveying path.

Figure 5B:
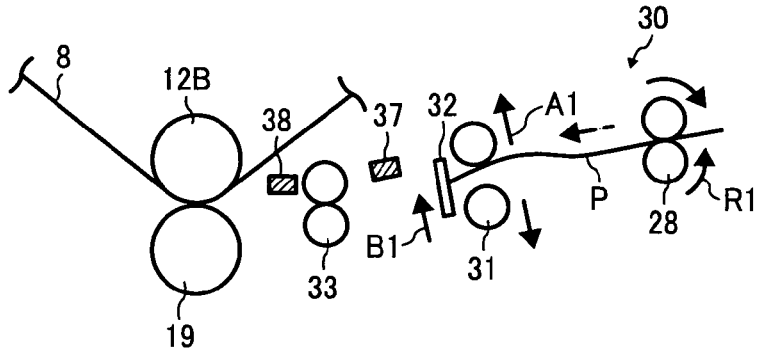
Figure 5C:
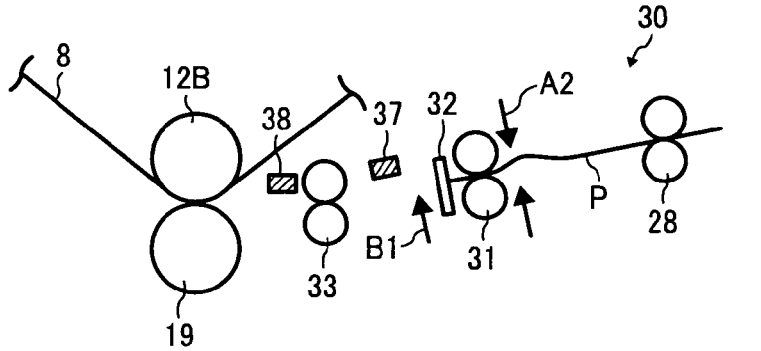

As shown in FIG. 5B, the sheet P is conveyed at a speed (with the number of revolutions of the conveying rollers 28) optimized by the driving unit 80. The leading edge of the sheet P bumps into the aligning member 32, and the sheet P stops. As shown in FIG. 5C, when the conveying rollers 28 stop rotating, the holding rollers 31 move in A2 direction to hold the sheet P. At this time, part of the sheet P deforms.

Thus, the leading edge of the sheet P bumps into the aligning member 32, whereby skew (slanting) of the sheet P is corrected. In other words, if the sheet P is conveyed askew (skewed) with respect to the conveying direction, part of the leading edge of the sheet P first bumps into the aligning member 32, and then, the other part also bumps into the aligning member 32 along with the first part. Consequently, skew of the sheet P is corrected.

Longitudinal registration of the sheet P is then corrected. Specifically, the holding rollers 31 rotates in timing with a color image on the intermediate transfer belt 8, and the sheet P is conveyed to the registration rollers 33.

As described above, the conveying rollers 28, the driving unit 80, the controller 81 are configured to change conveyance speed of a sheet immediately before the sheet bumps into the aligning member 32. The conveyance speed is changed based on the type of a sheet conveyed on the conveying path. Specifically, when thickness (or rigidity) of a sheet is equal to or less than a predetermined value, the conveyance speed of the sheet immediately before the sheet bumps into the aligning member 32 is reduced to lower than a normal conveyance speed.

More specifically, when a sheet (e.g., a thin sheet such as a tracing paper) having a weighing capacity, indicative of thickness or rigidity of the sheet, equal to or less than 60 g/m2 is conveyed, the conveyance speed of the sheet immediately before it bumps into the aligning member 32 is reduced. Thus, when a thin or brittle sheet bumps into the aligning member 32, the leading edge of the sheet is prevented from suffering from damage (flaw X shown in FIG. 7 corresponding to a surface of the aligning member 32) or the sheet is prevented from being buckled.

When a sheet is not thin (e.g., an ordinary sheet having a weighing capacity equal to or more than 70 g/m2), the sheet is conveyed at a normal conveyance speed without reducing conveyance speed of the sheet immediately before it bumps into the aligning member 32.

Information on the type of a sheet (thickness or rigidity) can be input by a user to the image forming apparatus 100 through its input unit, or obtained from a sensor arranged in the image forming apparatus 100 to detect the type of a sheet. Then, the controller 81 controls the driving unit 80 based on the information to adjust conveyance speed of a sheet.

Figure 5D:
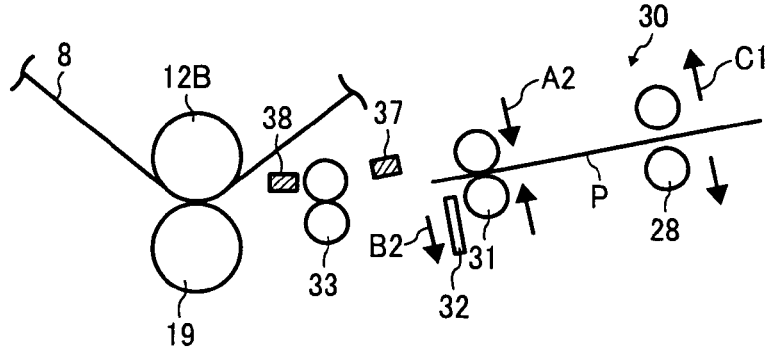

As shown in FIG. 5D, along with movement of the conveying rollers 28 in a direction (C1 direction) to open the conveying path, the aligning member 32 moves in a direction (B2 direction) to open the conveying path. With this, the sheet P is held by the holding rollers 31 alone.

Figure 6A:
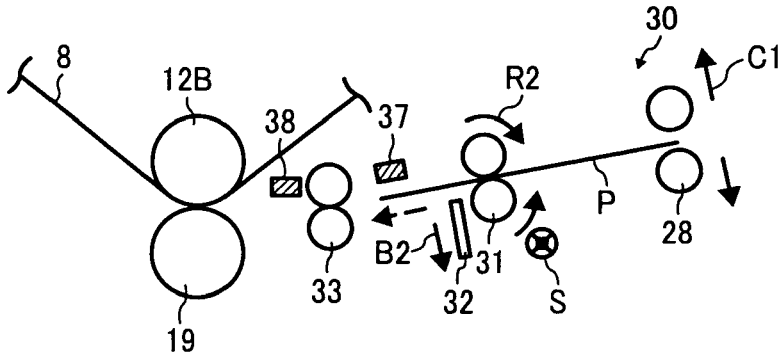
FIGS. 6A to 6D are schematic diagrams for explaining the operation of the conveying device after that shown in FIGS. 5A to 5D.

As shown in FIG. 6A, then, the sheet P is conveyed to the registration rollers 33 (in a direction indicated by a broken-line arrow) with rotation of the holding rollers 31 in R2 direction. At this time, the CIS 37 detects an amount by which the sheet P shifts in lateral registration, and the holding rollers 31 move in a vertical direction with respect to a sheet surface (S direction) to offset the amount. For example, as shown in FIG. 4, when the sheet P shifts by three millimeters to the right in lateral registration, the holding rollers 31 that hold the sheet P are shifted by three millimeters to the left.

Figure 6B:
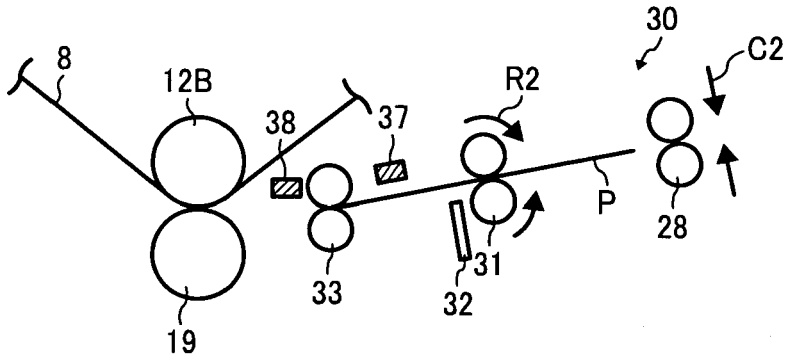

As shown in FIG. 6B, the leading edge of the sheet P of which lateral registration has been corrected bumps into the registration rollers 33, and the sheet P stops. The conveying rollers 28 move in the conveying direction (C2 direction) to be ready for the following sheet.

Figure 6C:
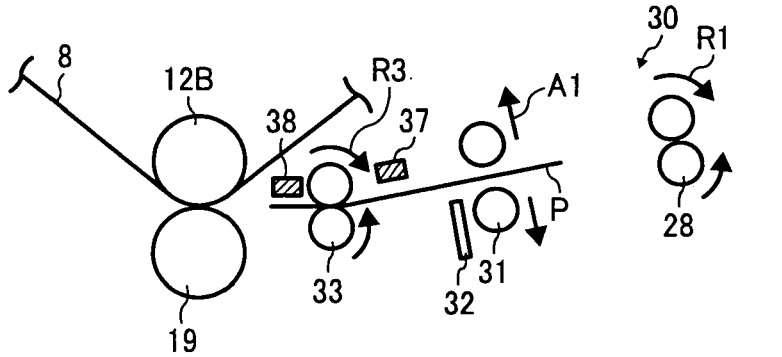

As shown in FIG. 6C, when the conveying rollers 28 resume rotating, the holding rollers 31 move in a direction of releasing the sheet P (A1 direction). When the registration rollers 33 rotate and the photosensor 38 detects the leading edge of the sheet P, the registration rollers 33 temporarily stops rotating.

Figure 6D:
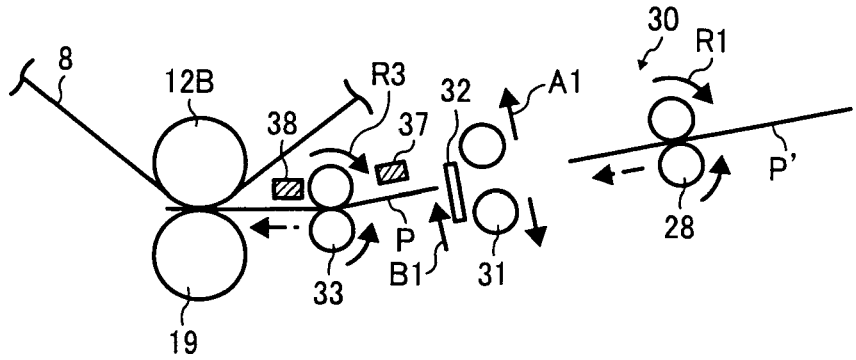

Longitudinal registration of the sheet P is then corrected. As shown in FIG. 6D, the sheet P is conveyed to the secondary transfer nip in tune with a color image on the intermediate transfer belt 8. Thus, a color image is transferred onto a desired position of the sheet P.

The number of revolutions of the registration rollers 33 can be changed by a variable driving motor (not shown). This makes it possible to adjust conveyance speed of a sheet conveyed from the registration rollers 33 to the secondary transfer nip, and adjust longitudinal registration more accurately.

The aligning member 32 moves in a direction of closing the conveying path (B1 direction) to be ready for skew correction of the following sheet P' conveyed by the conveying rollers 28.

It is preferable that, when conveyance speed of a sheet is reduced by the conveying rollers 28, the driving unit 80, the controller 81 immediately before the sheet bumps into the aligning member 32, conveyance speed of the sheet be increased afterward on the conveying path opened by the aligning member 32. That is, it is preferable that, if conveyance speed of a sheet is reduced, the conveyance speed be increased when the sheet is in the state shown in FIG. 6A. Thus, if conveyance speed is reduced immediately before skew correction, it is possible to prevent productivity of the image forming apparatus 100 from reducing as a whole because time loss caused by reducing the conveyance speed can be offset by increasing the conveyance speed afterward.

It is also possible to increase conveyance speed of a sheet having thickness (or rigidity) equal to or more than a predetermined value (e.g., a sheet having a weighing capacity of 220 g/m2). In other words, when a sheet is thick enough and less likely to be damaged upon bumping into the aligning member 32, conveyance speed of the sheet is increased so that productivity of the image forming apparatus 100 as a whole is maintained.

The aligning member 32 for skew correction is explained above as being in a plate shape and having a surface into which the leading edge of a sheet bumps. However, the aligning member can be a pair of rollers that forms a nip into which the leading edge of a sheet bumps. For example, when the leading edge of a sheet bumps into a nip between the registration rollers 33 and thereby skew of the sheet is corrected, conveyance speed of the sheet conveyed to the registration rollers 33 (the number of revolutions of the holding rollers 31) is changed. With this, the same effect as described above can be achieved. In this case, the conveying path is closed by stopping rotation of the registration rollers 33 and is opened by rotating the registration rollers 33 in R3 direction.

Figure 7:
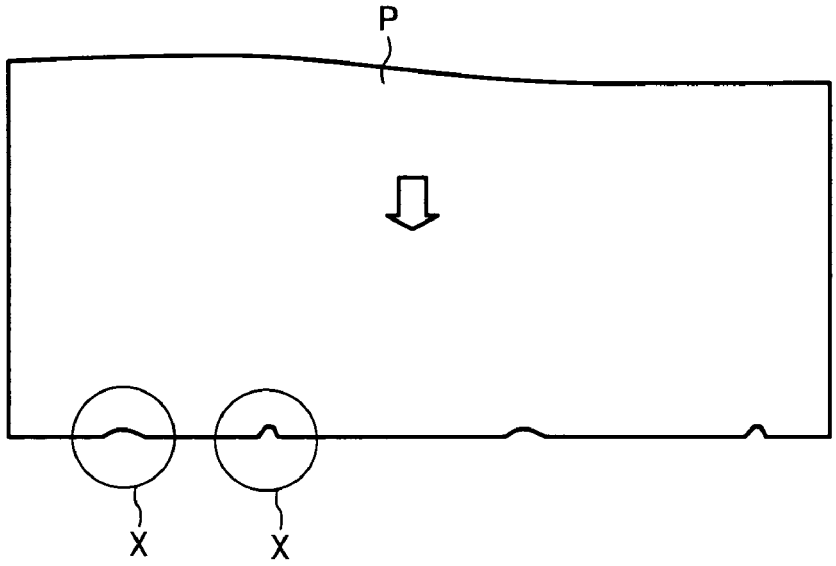
FIG. 7 is a schematic diagram of a recording medium the leading edge of which is damaged.

While, in the above description, conveyance speed of a sheet to bump into the aligning member 32 is changed automatically based on the type of the sheet, a user can manually change it, upon finding that an output sheet is damaged as shown in FIG. 7, by operating an operating unit of the image forming apparatus 100. In addition, by detecting an amount by which a sheet is deformed when the sheet bumps into the aligning member 32, conveyance speed of the sheet to bump into the aligning member 32 can be changed based on the amount. In these cases also, substantially the same effect can be achieved.

As described above, according to the embodiment, conveyance speed of a sheet to bump into the aligning member 32 can be changed. Thus, skew of a sheet can be accurately corrected in the conveying device 30 without causing damage to the sheet.

While, in the above embodiment, an image carrier is explained as an intermediate transfer belt, the image carrier can be a photosensitive element such as a photosensitive drum and a photosensitive belt. In this case, by controlling conveyance speed of a recording medium to be conveyed to the transfer unit to transfer an image formed on the photosensitive element onto the recording medium, the same effect as described above can be achieved.

Incidentally, the number, position, shape, etc. of the components are cited above by way of example and without limitation, and can be changed as required.

As set forth hereinabove, according to an embodiment of the present invention, conveyance speed of a recording medium to bump into an aligning member can be controlled. Thus, skew of a recording medium is accurately corrected without causing damage to the recording medium.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A conveying device that conveys a recording medium, the conveying device comprising:

an aligning member into which a leading edge of the recording medium bumps thereto; and a control unit that changes conveyance speed of the recording medium moving on a conveying path to bump into the aligning member based on thickness or rigidity of the recording medium, wherein when thickness or rigidity of the recording medium is equal to or less than a set value, the conveyance speed of the recording medium immediately before the recording medium bumps into the aligning member is reduced to a speed lower than in comparison to when thickness or rigidity of the recording medium is more than the set value, and after reducing conveyance speed, the conveyance speed is increased to a speed higher than in a case when thickness or rigidity of the recording medium is more than the set value, so as to offset a lag caused by reducing the conveyance speed, and wherein the thickness or rigidity of the recording medium is input by a user via an input unit in an image forming apparatus or obtained from a sensor arranged in the image forming apparatus.

2. The conveying device according to claim 1, wherein, when thickness of the recording medium is equal to or more than a predetermined value, the control unit increases conveyance speed of the recording medium.

3. The conveying device according to claim 1, wherein the aligning member closes the conveying path so that the leading edge of the recording medium bumps into the aligning member, and opens the conveying path after aligning the recording medium.

4. The conveying device according to claim 1, wherein the recording medium is conveyed to a transfer unit that transfers an image carried on an image carrier onto the recording medium.

5. The conveying device according to claim 1, wherein the aligning member is a plate member that has a surface into which the leading edge of the recording medium bumps.

6. The conveying device according to claim 1, wherein the aligning member is a pair of rollers that forms a nip into which the leading edge of the recording medium bumps.

7. The conveying device according to claim 1, further comprising a holding roller that is arranged upstream of the aligning member in a conveying direction of the recording medium and that moves in a width direction while holding the recording medium that is abutting the aligning member to correct misalignment of the recording medium in a width direction of the recording medium, and a registration roller that is arranged downstream of the aligning member in the conveying direction and that, after the holding roller corrects misalignment in the width direction, corrects misalignment in the conveying direction.

8. The conveying device according to claim 1, wherein the control unit changes conveying speed of the recording medium moving on the conveying path immediately before bumping into the aligning member based on the thickness of the recording medium.

9. The image forming apparatus according to claim 1, wherein the control unit changes conveying speed of the recording medium moving on the conveying path immediately before bumping into the aligning member based on the rigidity of the recording medium.

10. An image forming apparatus comprising:

a conveying device including:

an aligning member into which a leading edge of the recording medium bumps thereto; and a control unit that changes conveyance speed of the recording medium moving on a conveying path to bump into the aligning member based on thickness or rigidity of the recording medium, wherein when thickness or rigidity of the recording medium is equal to or less than a set value, the conveyance speed of the recording medium immediately before the recording medium bumps into the aligning member is reduced to a speed lower than in comparison to when thickness or rigidity of the recording medium is more than the set value, and after reducing conveyance speed, the conveyance speed is increased to a speed higher than in a case when thickness or rigidity of the recording medium is more than the set value, so as to offset a lag caused by reducing the conveyance speed, and wherein the thickness or rigidity of the recording medium is input by a user via an input unit in the image forming apparatus or obtained from a sensor arranged in the image forming apparatus.

11. The image forming apparatus according to claim 10, wherein the control unit changes conveying speed of the recording medium moving on the conveying path immediately before bumping into the aligning member based on the thickness of the recording medium.

12. The image forming apparatus according to claim 10, wherein the control unit changes conveying speed of the recording medium moving on the conveying path immediately before bumping into the aligning member based on the rigidity of the recording medium.

* * * * *